United States Patent [19]

Speers et al.

[11] 4,068,353

[45] Jan. 17, 1978

[54] CARTON CLIP

[75] Inventors: Samuel F. Speers, North Attleboro; James L. Pelto, Fitchburg, both of Mass.

[73] Assignee: Hasbro Development Corporation, Pawtucket, R.I.

[21] Appl. No.: 766,766

[22] Filed: Jan. 31, 1977

[51] Int. Cl.[2] ..... A44B 21/00

[52] U.S. Cl. ..... 24/81 BF

[58] Field of Search ..... 292/253, 258; 24/85 B, 24/81 BF, 73 MF, 73 B, 73 PL, 73 AS, 73 AC, 73 D, 81 PC; 229/45, 47

[56] References Cited

U.S. PATENT DOCUMENTS

| | | | |
|---|---|---|---|
| 2,801,453 | 8/1957 | Melvin | 24/81 BF |
| 2,867,019 | 1/1957 | Streeter et al. | 24/81 BF |
| 2,950,514 | 8/1960 | Small | 24/81 BF |

*Primary Examiner*—G. V. Larkin

*Attorney, Agent, or Firm*—Salter & Michaelson

[57] ABSTRACT

A clip for use with a carton having folding closure flaps wherein such clip may be selectively used to maintain such flaps in a closed position or to maintain adjacent flaps in an open position. The structure of the clip includes separate wing-like members interconnected at base portions thereof and an elongated leg connected to such wings at their base portions and extending therebetween preferably to a position substantially forward of the forward terminal portions of such wings. Portions of the carton are disposed in frictional engagement between the lower surfaces of the wings and the upper surface of the leg when the device is utilized in either of its above indicated alternative modes.

10 Claims, 6 Drawing Figures

CARTON CLIP

BACKGROUND AND SUMMARY OF THE INVENTION

Carton clips of the type utilized to hold open the flaps of a regular slotted carton while such is being filled are well known and may take the form of those devices shown by the following U.S. Pat. Nos.: 2,375,374; 2,582,502; 2,801,453; and 2,950,514. Such clips, once utilized, must be stored for subsequent reuse or thrown away, and in either case are used solely for the purpose indicated, i.e., to maintain the carton flaps open. It is also known to utilize separate clips to maintain closure flap portions of such cartons in a closed position, either permanently or temporarily. Such clips may take the form as disclosed in U.S. Pat. No. 3,707,023. Until now the temporary maintenance of closure flaps in an open loading position and the subsequent closure thereof either temporarily or permanently has required the use of separate clips for these purposes thus requiring that separate inventories be maintained.

It is accordingly an object of the present invention to provide a clip structure of novel and useful configuration which can be utilized to maintain closure flaps of a standard carton in a temporary but secure closed position.

Another object of the present invention is the provision of a carton clip of unique configuration which may not only serve to maintain standard cartons in closed position but which alternatively may be used to maintain adjacent closure flaps of such cartons in an open loading position, thus eliminating the need for separate and different carton clips to independently perform both functions.

Such objects and those that may be apparent hereinafter are accomplished by the provision of a clip having a pair of coplanar wings spaced from each other at forward portions thereof and interconnected at base portions thereof, a longitudinally orientated leg connected thereto at said base portions, such leg disposed between and preferably projecting substantially beyond the forward terminal portions of said wings in such manner that the under portions of said wings and the upper portions of said leg cooperatively form respectively first and second carton contacting surfaces whereby different portions of said carton may be disposed between such surfaces so as to alternatively maintain opposed side closure flaps in a closed position or maintain adjacent closure flaps of said carton in an open position.

Other objects, features, and advantages of the invention will become apparent as the description thereof proceeds when considered in connection with the accompanying illustrative drawing.

DESCRIPTION OF THE DRAWING

In the drawing which illustrates the preferred embodiment presently contemplated for carrying out the present invention.

DESCRIPTION OF THE INVENTION

Figure 1:
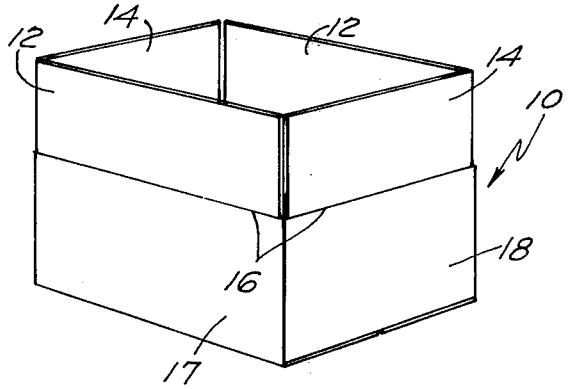
FIG. 1 is a perspective view of a carton to which the clip of the present invention has utility.

Referring to the drawing and more particularly to FIG. 1 thereof, a carton 10 of the type having utility in conjunction with the clip of the present invention is depicted. Such carton 10 includes side and end closure flaps 12 and 14, respectively, which by reason of their ability to pivot about top edge fold lines 16 serve to alternatively maintain such carton 10 in open and closed positions. The carton may be of any type exhibiting such closure flap characteristics but generally is of a standard corrugated paperboard folding type and includes those type cartons generally referred to as regular slotted cartons. Such cartons include side and end walls 17, 18, respectively, and a bottom structure usually defined by folded flaps similar to the flaps 12, 14, which folded flaps may be maintained in closed position by sealing tape or the like or as will be hereinafter brought out by clips of the present invention.

Figure 2:
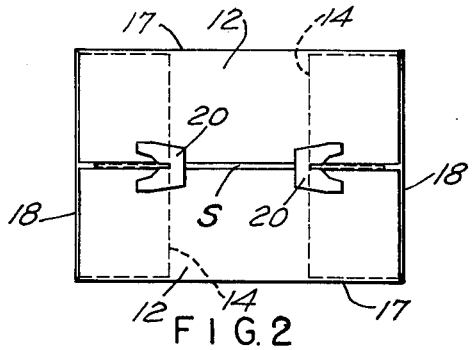
FIG. 2 is a top plan view of such a carton in closed position, such position being maintained by clips made in accordance with the present invention.

In the closed position depicted in FIG. 2 of the drawing, the end flaps 14 are each downwardly and inwardly folded as shown by the dotted line configuration thereof and thereafter the side flaps or panels 12 are folded inwardly thereabove. It is in such relative positioning of the closure flaps 12, 14 that the carton clip 20 of the present invention serves to maintain such in a secure closed position; however, such clip or clips may be readily removed and thus are suited for maintaining bottom and/or top carton flaps in either temporary or longer range closed position.

The clip 20 includes a pair of wings 22 having forward portions 24 and interconnected base portion 26. Such wings 22 are in coplanar relationship with each other and preferably, as depicted, are of relatively thin flat configuration. They are separated from each other at the forward portions 24 thereof by a major cut-out 28 defined by longitudinally extending laterally opposed side edges 30. The major cut-out is accordingly of gable-like configuration and may include a narrow slotted opening 32 forming a continuation at the apex thereof to facilitate molding by injection molding techniques.

A forwardly projecting longitudinally orientated leg 33 of overall blade-like configuration is connected to the wings 22 generally at a normal disposition therewith at the base portion 26 thereof and extends forwardly so as to preferably bisect the cut-out portion 28 and the slotted opening 32. The leg 33 at its base connection defines a base 34 and U-shaped opening 35 between such leg and the lower surfaces of the wings 22. Such leg 33 also includes a nose portion 36 having in turn an upwardly slanted surface or ramp 38 terminating at a point 40 disposed at a height approximately equal to but which may be slightly above or below the plane defined by the lower surfaces of each wing 22. The remainder or main upper portions of the leg 33 form a surface 42 which slopes longitudinally rearwardly and downwardly from its highest point 40 to its connection with under portions of the wings 22 at the base portion 26 thereof where its disposition beneath the plane formed by the under surfaces of the wings 22 is spaced at opening 35 at least a distance equal to the thickness of a normal carton flap for purposes as will be hereinafter more apparent. The clip 20 is preferably formed of hard, somewhat stiff plastic material such as high density polyethylene, polypropylene, or rubber modified polystyrene having high impact characteristics and preferably is injection molded in intregal configuration and may include strengthening gusset portions 44 at the point at which the leg interconnects with the wings, as best shown in FIG. 3 of the drawing.

As will be apparent from the above description, the spacing between lower surface portions of the wings 22 which serve to form a first carton contacting surface and the main upper edge portion 42 of the leg 33 in turn serving to form a second carton contacting surface is variable due to the flexibility of the wings 22 and the leg 33 and such spacing is dependent upon the relative stress placed on such first and second contacting surfaces; inasmuch as a carton portion or portions representing either a single or double thickness thereof serves to expand such spacing by being wedged or forced between said contacting surfaces.

Figure 3:
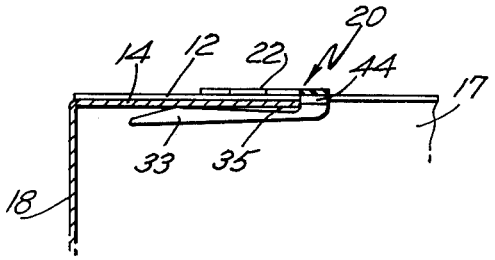
FIG. 3 is a partial side sectional view taken through the carton and one of the clips depicted in FIG. 2 of the drawing.

The use of the clip 20 of the present invention to temporarily but securely hold closure flaps of a carton 10 in closed position may best be seen by simultaneous reference to FIGS. 2 and 3 of the drawing wherein side flaps 12 are shown overlying the end flaps 14; the spacing S between the side flaps 12 being of such an extent as to accommodate the relative narrow thickness of the leg 33 and the end flaps 14 being spaced a relatively large distance away from each other as is common with this type of carton. In such a position, the clip 20 may be inserted nose first into the space S between the closure flaps 12 so as to project inwardly of the carton, and the clips are slid longitudinally along space S until the leg 33 underlies the flaps 14 at which point the wing portions 22 of the clips contact the upper surfaces of the side closure flaps 12. Thus, as the first carton contacting surfaces defined by the under portions of the wings 22 of the clip 20 slide along the upper portions of the side closure flaps 12, the second contacting surface defined by upper edge portions 42 of the leg 33 initially contact under portions of one of the closure flaps 14 at the ramp portion 38 thereof and as the clip is moved towards the end portions of the container, the upward slope of such ramp 38 assures a continual frictional engagement between such first and second carton contacting surfaces by, in effect, the forced downward movement of the leg 33. At the same time each wing 22 by reason of its major separation from each other is able to independently deflect to account for possible differences in the thicknesses or surface characteristics of the side closures 12.

The clip 20 may be positioned so that only portions of the edge 42 contact the end flap 14 for an intermediate or somewhat temporary closure of the container or the clip 20 may be entirely moved to its full extent towards the end panels 18 of the container, as depicted in FIG. 3, wherein the inner edge of the closure flaps 14 encompassed thereby is disposed in abutment with the base 34 of the U-shaped opening 35. It will be clear that one clip 20 is all that is necessary to hold the carton in its closed position, although if a more secure closure is desired, two clips may be utilized, as illustrated in FIG. 2. The cartons 10 in such temporarily closed condition may accordingly be utilized for shipment of articles either within a plant, as from department to department, or to distant points as by shipment through the mail or other carriers and in such latter instances it may be desirable to place some easily frangible material over one or both such clips to deter and/or make readily observable any opening of the carton during such shipment. Upon receipt of the closed carton, the clip or clips 20 may be easily removed and the carton opened and similarly reclosed and reopened a great many times, thus facilitating and maximizing reuse of such cartons.

While the clip or clips have been illustrated as useful to secure the closure flaps of the top flaps of a reverse slotted carton, it should be clear as previously indicated that the bottom closure flaps may also be maintained in closed position by the clip or clips 20. Thus to assure maximum closing a total of four clips, two each to secure top and bottom closure flaps, could be utilized and that a carton so set up could after use be quickly disassembled and laid flat so as to reduce storage space. The use of the clips of the present invention further eliminates excessive carton sealing, unsealing and resealing procedures which tend to damage the carton and thus shorten its useful life.

Figure 4:
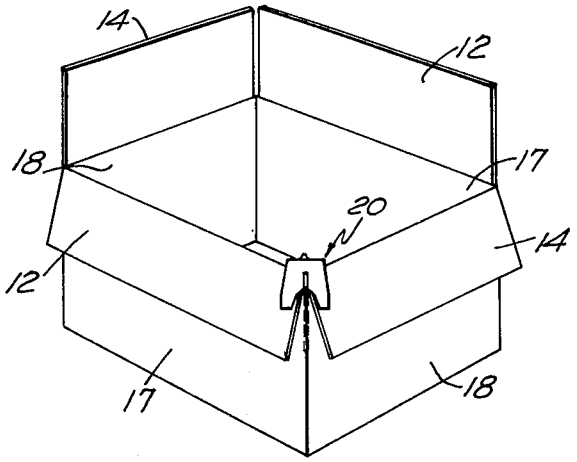
FIG. 4 is a perspective view showing how one of the clips of the present invention may be utilized to maintain adjacent closure flaps of a carton in an open position.
Figure 5:
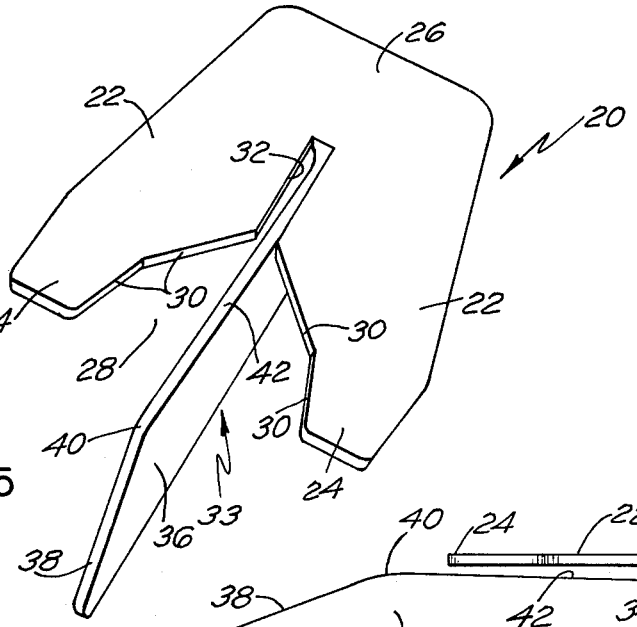
FIG. 5 is a perspective view showing the construction of the clip of the present invention.
Figure 6:
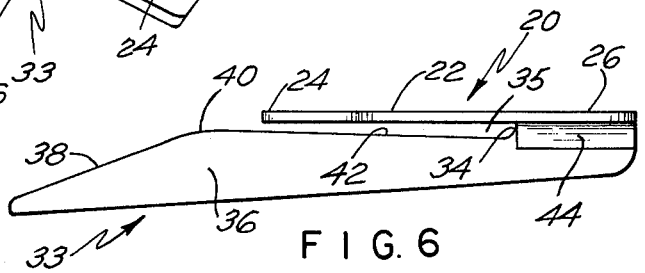
FIG. 6 is a side view thereof.

Turning now to FIG. 4 of the drawing, the manner in which the clip 20 of the present invention is utilized to temporarily maintain adjacent side and end panels 12, 14, respectively, in an open position is therein depicted. To accommodate such positioning as is desirable during filling of the container with articles and the like, adjacent closures 12 and 14 are folded over against outside portions of the respective side 17 and end panels 18 of the carton. The clip 20, in vertical orientation, is then inserted thereover with the leg 33 thereof disposed inwardly of the carton and in contact with an inner corner thereof while the wing portions 22 thereof serve to contact lower surface portions of the respective closure flaps 12 and 14, as illustrated in FIG. 4. In such orientation, it should be clear that portions of the edges of the respective side and end flaps 12, 14 are permitted to extend within the major cut-out 28 so that portions of the laterally opposed edges 30 in addition to lower surfaces of the wings 22 are placed in contact with, that is, frictionally engage portions of the flaps, as depicted, so as to maintain such in an open position. Again, as in the usage of the clip 20 as a closure mechanism as previously explained, the width of the opening 35 is of an extent so as to snugly accommodate the thickness of the corner portions of the carton 10 in such a manner so as to ensure that the normal, natural tendency of the flaps 12, 14 to spring upwardly with respect to the side panels of the container 10 will not serve to upwardly displace the clip from the position depicted in FIG. 4.

It is accordingly believed that a carton clip of novel configuration is herein described which serves not only to maintain carton closure flaps in a temporary closed position in a new and novel manner but additionally may be utilized to further temporarily maintain adjacent side and end closure flaps of such a container in an open, article receiving position.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A clip for use with a regular slotted carton having adjacent side and end foldable closure flaps, said clip being selectively usable for temporarily holding opposed side flaps in a closed position and adjacent side and end flaps in an open position, and comprising a pair of generally coplanar wings spaced from each other at forward portions thereof and interconnected at base portions thereof so as to cooperatively form a first carton contacting surface of a generally flat configuration, a longitudinally orientated leg connected to said first carton contacting surface at said wing base portions thereof, said leg disposed between said wings and having a relatively thin upper edge forming a second carton contacting surface having the main portions thereof generally disposed below and spaced from said first surface whereby said first surface is adapted to contact top portions of said side flaps and said second surface is adapted to contact bottom portions of one of said end flaps in said closed position, and whereby said first surface is adapted to contact bottom portions of said adjacent flaps and said second surface is adapted to contact interior wall corner portions of said carton in said alternate open position.

2. The clip structure set forth in claim 1, wherein said leg is generally of thin blade-like configuration and disposed generally normal to said first carton contacting surface.

3. The structure set forth in claim 2, wherein said leg is integrally connected to said wings and said clip is formed of thin relatively stiff plastic material.

4. The clip structure set forth in claim 2, said leg projecting substantially beyond the forward terminal portions of said wings.

5. The clip structure set forth in claim 4, said leg and said wings, respectively, being slightly downwardly and upwardly flexible to vary the spacing between said first and second surfaces so as to accommodate different thickness carton portions therebetween.

6. The clip structure set forth in claim 5, said leg having an upwardly sloped nose portion positioned between, slightly forward of and laterally spaced from each of the forward terminal portions of said wings, said nose portion having an upper edge portion disposed at a level proximate to the plane defined by said first carton contacting surface then gradually tapering away therefrom to assure a continual frictional engagement with carton portions during progressive contact therewith.

7. The clip structure set forth in claim 4, said wings laterally spaced from each other to define inner edges thereof, said respective wings having longitudinally directed inner side edges laterally opposed to each other to define a major rearwardly projecting cut-out portion in said first carton contacting surface so as to separate said wings laterally from each other, said opposed side edges forming tertiary carton contacting surfaces for contacting portions of adjacent flaps disposed within said cut-out portion in said open flap position.

8. The clip structure set forth in claim 7, said wings further separated from each other by a narrow longitudinally orientated slot disposed between said wing base portions and said major cut-out.

9. The clip structure set forth in claim 8, said leg substantially bisecting said slot and said major cut-out.

10. The clip structure set forth in claim 9, said major cut-out essentially defining a cable configuration.

* * * * *